US007506585B2

(12) United States Patent
Kündgen et al.

(10) Patent No.: US 7,506,585 B2
(45) Date of Patent: Mar. 24, 2009

(54) METHOD OF OPERATING A PRESS

(75) Inventors: Rolf Kündgen, Bad Schönborn (DE); Gerd Merkel, Dielheim (DE); Bernd Sitzmann, Sandhausen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 97 days.

(21) Appl. No.: 11/407,676

(22) Filed: Apr. 20, 2006

(65) Prior Publication Data

US 2006/0236883 A1 Oct. 26, 2006

(30) Foreign Application Priority Data

Apr. 20, 2005 (DE) ..... 10 2005 018 332

(51) Int. Cl.
*B41F 33/00* (2006.01)

(52) U.S. Cl. ..... 101/483; 101/425

(58) Field of Classification Search ..... 101/483, 101/425

See application file for complete search history.

(56) References Cited

U.S. PATENT DOCUMENTS 4,015,307 A * 4/1977 Kossak ..... 15/256.52
5,224,424 A * 7/1993 Layland ..... 101/425
6,029,575 A * 2/2000 Bischer ..... 101/425
6,308,627 B1 * 10/2001 Konig et al. ..... 101/425
6,412,414 B1 * 7/2002 Loos ..... 101/425

FOREIGN PATENT DOCUMENTS

| | | |
|---|---|---|
| DE | 195 06 640 A1 | 8/1996 |
| DE | 199 58 087 A1 | 6/2000 |
| DE | 100 44 861 A1 | 5/2001 |
| DE | 100 00 558 A1 | 7/2001 |
| EP | 0 591 634 A1 | 7/1993 |

* cited by examiner

*Primary Examiner*—Anthony H. Nguyen
(74) *Attorney, Agent, or Firm*—Laurence A. Greenberg; Werner H. Stemer; Ralph E. Locher

(57) ABSTRACT

A printing press has a printing unit with a cylinder and a cleaning device that is mounted for selective displacement into an operating position for cleaning the cylinder and into a maintenance position away from the cylinder. The operating position is located within the printing unit and the maintenance position, although being located outside the printing unit, is located on the press. While the press runs in printing operation, the cleaning device is kept away from the operating position.

8 Claims, 4 Drawing Sheets

METHOD OF OPERATING A PRESS

BACKGROUND OF THE INVENTION

Field of the Invention

The present invention relates to a method for operating a printing machine which comprises a printing unit having a cylinder and a cleaning device which is mounted such that it can optionally be displaced into an operating position for cleaning the cylinder and into a maintenance position. The operating position is located within the printing unit and the maintenance position, although located outside the printing unit, is located on the press.

Such a method is disclosed in the commonly assigned U.S. Pat. No. 6,308,627 B1 and in its counterpart German patent application DE 199 58 087 A1. In the case of the press described therein, a protective covering is used as a supporting table for the cleaning device when in its horizontal position. The cleaning device is located in the maintenance position by the cleaning device lying on the inner side of the opened protective covering. Since the protective covering is a constituent part of the press, although the cleaning device is located outside the printing unit when in the maintenance position, it is located on the press.

If the maintenance work to be carried out on the cleaning device does not last for a long time, then, after the maintenance work has been completed, the cleaning device is displaced back from the maintenance position into the operating position, so that the printing operation can be resumed again after that. If, on the other hand, the maintenance work lasts for a longer time, instead of the cleaning device to be maintained, a replacement device that is kept ready is inserted into the press, so that the printing operation can be continued without delay as a result of the rapid exchange of the cleaning devices.

The disadvantage here is that the replacement device must be present for the case in which the maintenance work lasts longer.

SUMMARY OF THE INVENTION

It is accordingly an object of the invention to provide a method of operating a printing machine which overcomes the above-mentioned disadvantages of the heretofore-known devices and methods of this general type and which renders it possible to dispense with the replacement device even in the case in which maintenance work lasts longer.

With the foregoing and other objects in view there is provided, in accordance with the invention, a method for operating a press, which has a printing unit with a cylinder and a cleaning device movably mounted for displacement into an operating position for cleaning the cylinder and into a maintenance position away from the cylinder. The operating position is defined within the printing unit and the maintenance position is defined outside the printing unit but on the press. According to the novel method, the press is run in a printing operation while the operating position is kept free of the cleaning device.

In other words, the method according to the invention for operating a press which comprises a printing unit having a cylinder and a cleaning device which is mounted such that it can optionally be displaced into an operating position for cleaning the cylinder and into a maintenance position, the operating position being located within the printing unit and the maintenance position, although being located outside the printing unit, being located on the press, is characterized in that the press runs in printing operation and, at the same time, the operating position is kept free of the cleaning device.

It is possible that, in the process, the operating position is not only kept free of the cleaning device (first cleaning device) but also free of a further cleaning device (second cleaning device) which is substantially identical and functions as a replacement device, if such a replacement device belongs to the press at all.

During the machine run, therefore, neither the first cleaning device nor the second cleaning device that is possibly but not necessarily present is located in the operating position. During this mode of the machine run, the operating position is unoccupied by the cleaning device or the cleaning devices. Of course, this does not rule out locating the first or the second cleaning device in the operating position in another mode of the machine run, for example after maintenance of the cleaning device has been carried out.

In accordance with an added feature of the invention, the printing unit is formed with an opening, a first protective covering for closing the opening, and a second protective covering for closing the opening, the opening being kept closed by means of the first protective covering during the running printing operation, and the cleaning device lying on the second protective covering when in the maintenance position.

In a further development, the first protective covering is closed automatically as the cleaning device is displaced from the operating position into the maintenance position. In this case, the automatic closure of the first protective covering can be effected by a spring. However, the automatic closure of the first protective covering can also be effected via a connecting element which connects the first protective covering to the cleaning device.

In a further development, the printing unit comprises an opening and at least one protective covering connected to the cleaning device for closing the opening, the opening being kept closed by means of the protective covering during running printing operation.

The invention also includes a press which is configured to carry out the method according to the invention or a method corresponding to one of the developments. In a preferred application, the press is a rotary press processing printing material sheets, the printing unit being an offset printing unit and the cylinder a blanket cylinder.

Other features which are considered as characteristic for the invention are set forth in the appended claims.

Although the invention is illustrated and described herein as embodied in a method for operating a press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1B:
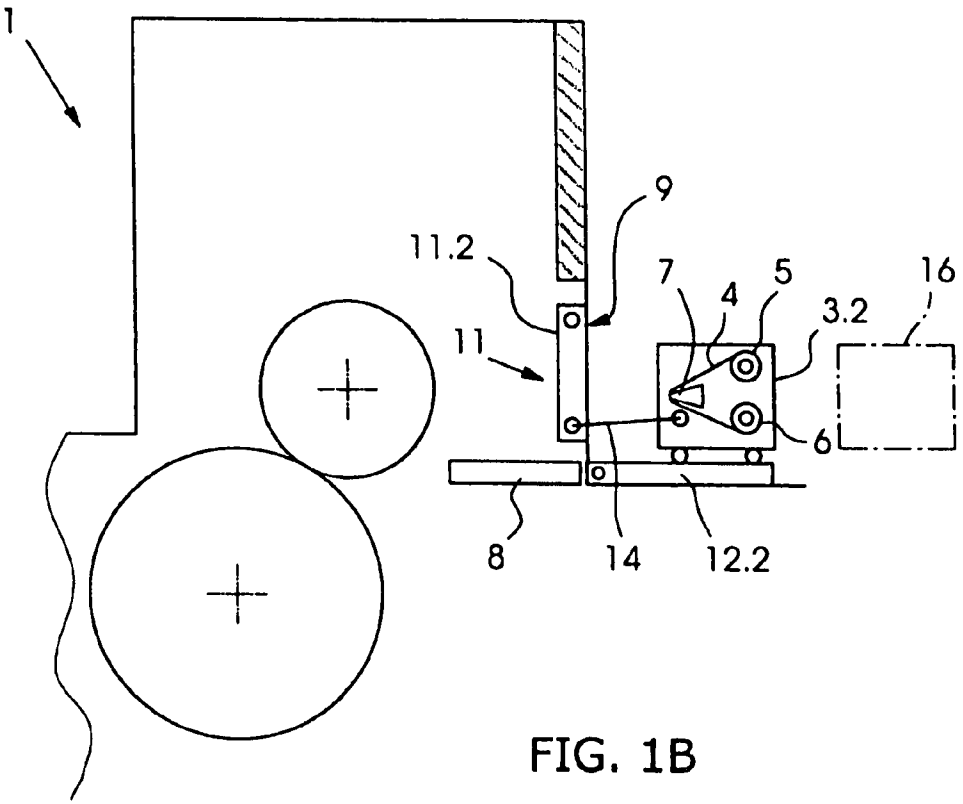
FIGS. 1A and 1B are schematic side views illustrating a first exemplary embodiment of the invention in which the cleaning device is connected to the protective covering via a coupler.

Referring now to the figures of the drawing in detail, all of the exemplary embodiments illustrated and described pertain to a press 1 with a printing unit 15 for offset printing. The printing unit 15 contains a cylinder 2, specifically a blanket cylinder. Furthermore, the press 1 comprises a cleaning device 3. The cleaning device 3 has a cleaning cloth 4, which is unwound from a first cloth roll 5 and is wound up onto a second cloth roll 6 of the cleaning device 3. Furthermore, the cleaning device 3 includes a pressing element 7 for pressing the cleaning cloth 4 against the cylinder 2. The printing unit 15 comprises a wall 10 having an opening 9 formed therein.

An operating position 3.1 of the cleaning device 3 is located within the printing unit 15. When the cleaning device 3 is in the operating position 3.1, the cleaning device 3 stands on a guide 8, which is formed with two mutually parallel rails that extend in one and the same horizontal plane. The guide 8 is at least partly disposed within the printing unit 15 and guides the cleaning device 3 into the operating position 3.1. There, the cleaning device 3 can clean the cylinder 2.

A maintenance position 3.2 for the maintenance of the cleaning device 3 is provided outside the printing unit 15. During the maintenance, for example, the cleaning cloth 4 is replaced by a fresh cleaning cloth 18 (cf. FIG. 3B) if the cleaning cloth 4 has been soiled completely as a result of its use. During its displacement from the operating position 3.1 into the maintenance position 3.2 and back again, the cleaning device 3 is moved through the opening 9. During its maintenance that is carried out in the maintenance position 3.2, the cleaning device 3 stands or lies on a component of the press 1. It is possible for the component to be a protective covering (cf. FIGS. 1B, 2B) or a foot board 17 (cf. FIG. 3B) or the guide 8 (cf. FIG. 4).

It is not necessary to lift the cleaning device 3 off the aforesaid component for its maintenance and, for example, to set it down on a table standing beside the press 1. The fact that the cleaning device 3 is carried by the press 1 in the maintenance position 3.2 is advantageous in particular when the press 1 is designed for a large printing material sheet format and, consequently, the cleaning device 3 is large, heavy and cumbersome.

Figure 1A:
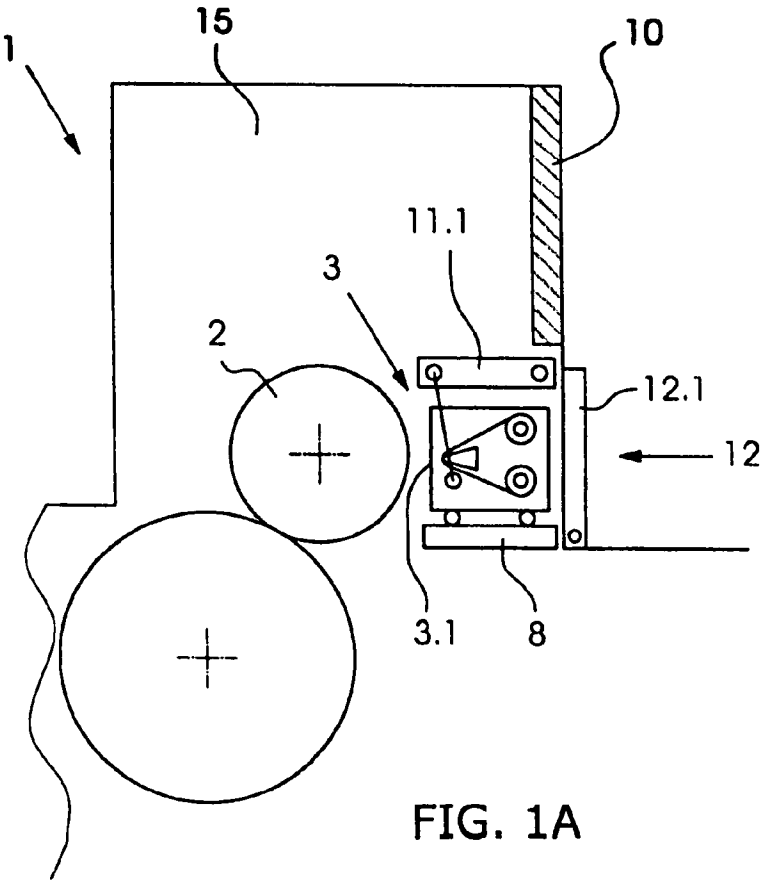

Referring now more particularly to the exemplary embodiment shown in FIGS. 1A and 1B, the wall 10 extends parallel to the axis of rotation of the cylinder 2. When the cleaning device 3 is in the maintenance position 3.2 (cf. FIG. 1B), the opening 9 is closed by a first protective covering 11 and the cleaning device 3 stands on a second protective covering 12. In order to be able to push or roll the cleaning device 3 out of the printing unit 15 and onto the second protective covering 12, the latter can be equipped on its inner side with guide rails adjoining the guide 8 in order to guide the cleaning device 3. When the cleaning device 3 is in the operating position 3.1 (cf. FIG. 1Aa), the opening 9 is closed by the second protective covering 12. The two protective coverings 11, 12 alternately closing the opening 9 are formed as flaps, the first protective covering 11 being folded down from a first position 11.1 into a second position 11.2 in order to close the opening 9, and the second protective covering 12 being folded down from a first position 12.1, in which it closes the opening 9, into a second position 12.2 in order to open the opening 9. When the opening 9 is closed by the first protective covering 11 and, during this time the press 1 runs in printing operation, that is to say the printing material sheets are transported and printed in the process, neither the (first) cleaning device 3 nor an additional (second) cleaning device 16 which may be present and which is at least substantially identical to the first cleaning device 3 is located in the interior of the printing unit 15. The operating position 3.1 is therefore unoccupied.

In that situation, namely with the cleaning device 3 displaced from the operating position 3.1 into the maintenance position 3.2, the second protective covering 12 can no longer be folded up in order to close the opening 9 since, during its maintenance, the cleaning device 3 is left standing on the second protective covering 12 assuming the second position 12.2. It is therefore advantageous that, in this situation, the first protective covering 11 is used to close the opening 9, so that the press 1 can continue to be operated without endangering the operator and the press 1, despite the cleaning device 3 being removed from the printing unit 15 and standing on the second protective covering 12. During the maintenance of the cleaning device 3, the first protective covering 11 prevents components detached from the cleaning device 3 or tool used for the purpose inadvertently getting into the running printing unit 15 and causing damage there.

When the cleaning device 3 is removed and the opening 9 is closed by the first protective covering 11, the first protective covering 11 actuates a non-illustrated electric switch (an emergency off switch or emergency stop switch), which enables the machine to run. When the cleaning device 3 is inserted again and the opening 9 is closed by the second protective covering 12, the switch is actuated by the second protective covering 12 in such a way that the switch permits the machine run. If the switch is actuated by neither of the two protective coverings 11, 12, the switch blocks or interrupts the machine run. Of course, it is also possible to provide two different switches for the safety purpose mentioned previously, it being possible for one to be actuated by the first protective covering 11 and the other by the second protective covering 12. The two switches can be connected in parallel within the circuit. Instead of the switch or switches, another sensor can also be provided.

Furthermore, it is advantageous with regard to handling that the cleaning device 3 is connected to the first protective covering 11 via a connecting element 14 in such a way that the displacement of the cleaning device 3 from the operating position 3.1 into the maintenance position 3.2 necessarily results in a displacement of the first protective covering 11 from the first position 11.1 into the second position 11.2—that is to say the closure of the opening 9. The connecting element 14 can be, for example, a coupler, which is attached by its one coupler end to the cleaning device 3 and by its other coupler end to the first protective covering 11. When the cleaning device 3 is displaced back into the printing unit 15, the connecting element 14 effects automatic folding up of the first protective covering 11.

The second cleaning device 16 is a replacement device, by means of which the first cleaning device 3 is replaced if the latter has a defect that cannot be repaired in the short term.

Figure 2B:
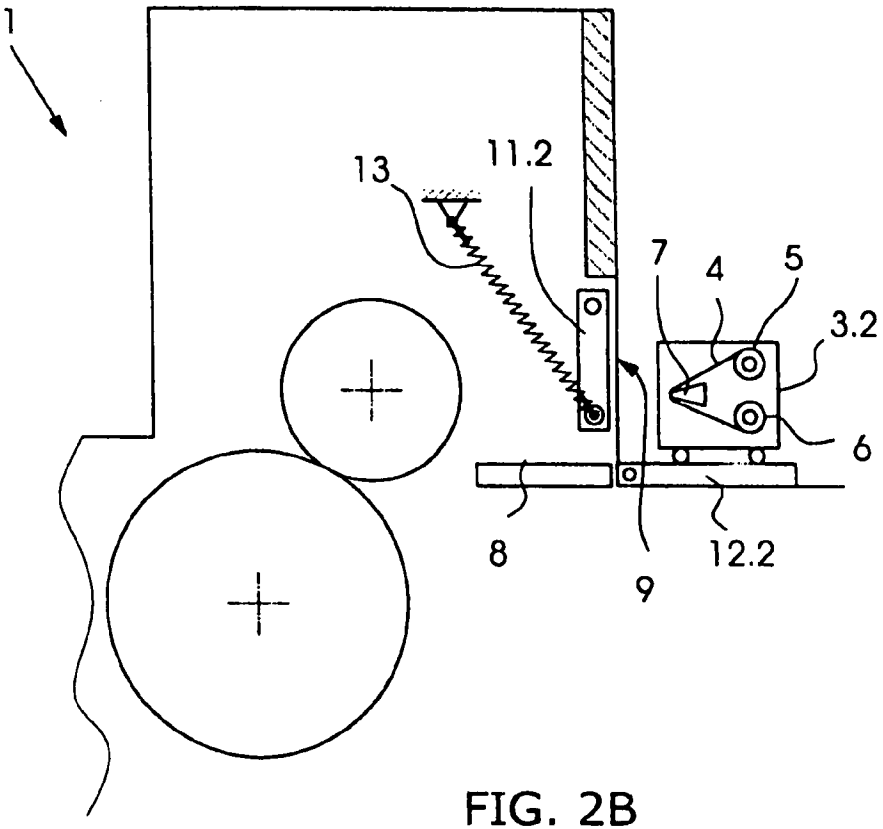
FIGS. 2A and 2B are schematic side views illustrating a second exemplary embodiment, in which the protective covering is loaded by way of a spring.
Figure 2A:
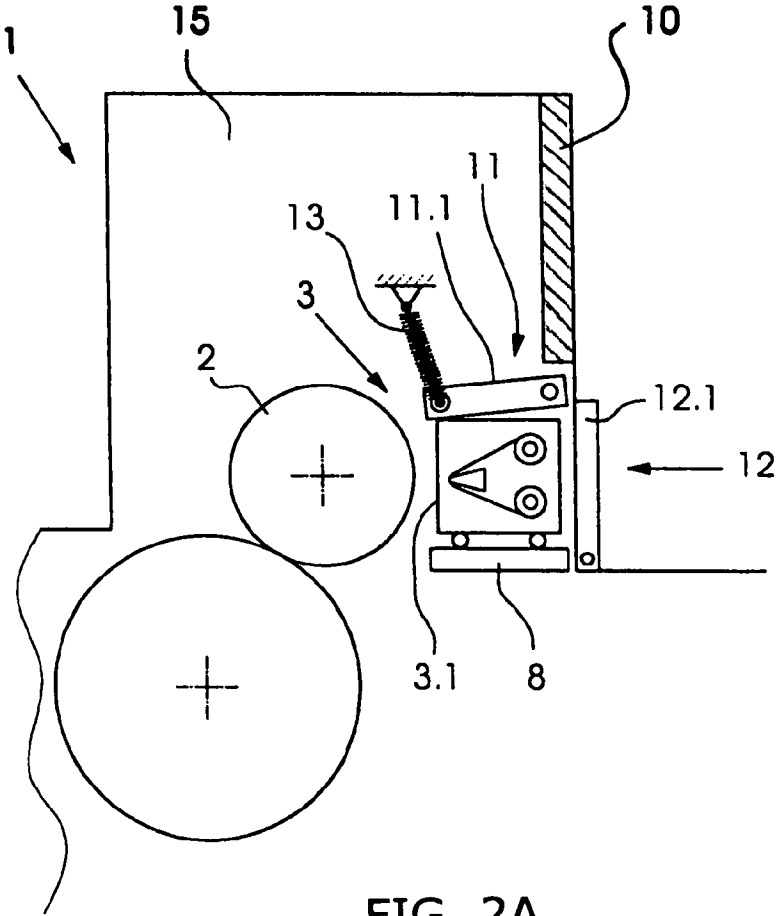

Referring now more specifically to FIGS. 2A and 2B, that exemplary embodiment differs from the exemplary embodiment of FIGS. 1A and 1B only in the replacement of the connecting element 14 by a spring 13. The prestressed spring 13 presses the first protective covering 11 against the cleaning device 3 when the latter is located in the operating position 3.1 (cf. FIG. 2A).

In addition, while the cleaning device 3 is being displaced from the operating position 3.1 into the maintenance position 3.2, the cleaning device 3 initially sliding or preferably rolling on the guide 8 and thereafter on the second protective covering 12, the spring 13 keeps the first protective covering 11 in contact with the cleaning device 3. The spring 13 moves the first protective covering 11 from the first position 11.1 into the second position 11.2. Only when the cleaning device 3 has left the printing unit 15 completely through the opening 9 during the course of its displacement and the opening 9 has been closed completely by the first protective covering 11 does the latter come into contact with a stop.

As the cleaning device 3 is displaced from the maintenance position 3.2 back into the operating position 3.1, the cleaning device 3 presses the first protective covering 11 out of the second position 11.2 into the first position 11.1, counter to the restoring force of the spring 13.

Figure 3B:
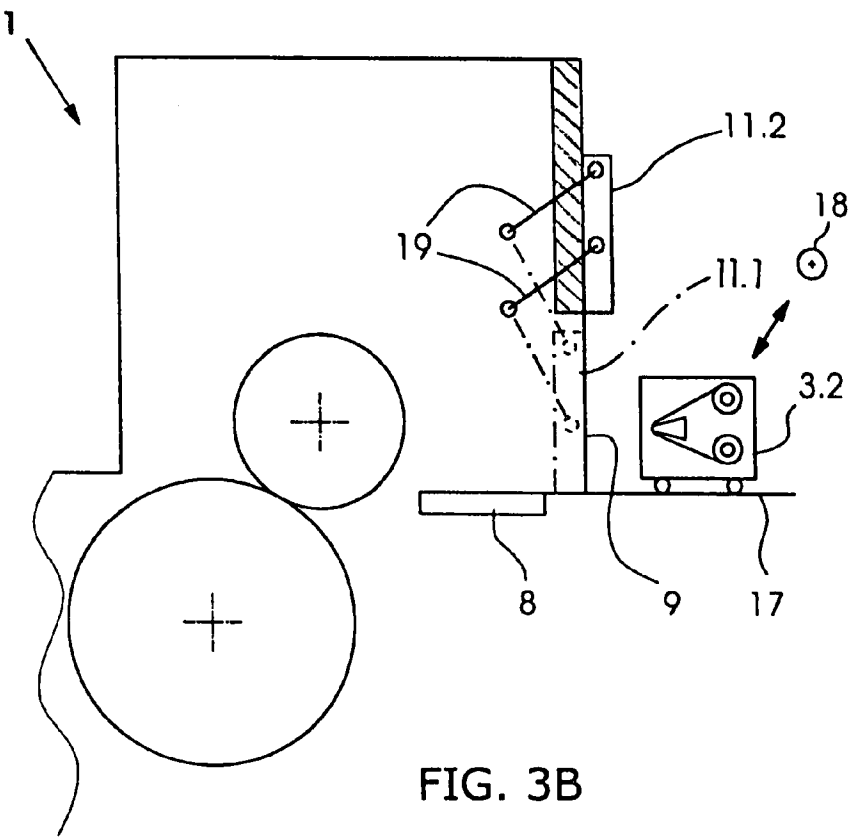
FIGS. 3A and 3B are schematic side views illustrating a third exemplary embodiment, in which there is only a single protective covering.
Figure 3A:
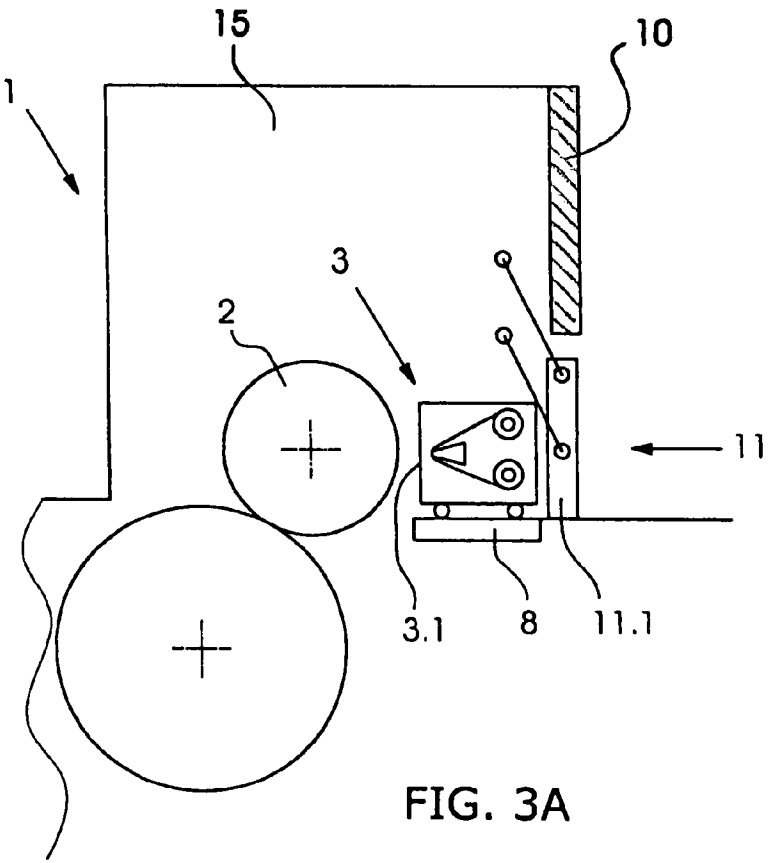

Referring now to FIGS. 3A and 3B, the third exemplary embodiment differs from the two exemplary embodiments described above substantially only with respect to the omission of the second protective covering 12. Here, the protective covering 11 is the only protective covering present and it is attached to the printing unit 15 via two mutually parallel couplers 19.

The coupler 19 could be omitted in accordance with modifications, not illustrated using the drawing, in which the protective covering 11 is constructed as a sliding door, a Venetian blind or as a roller blind.

In the exemplary embodiment illustrated in the drawing, the protective covering 11 is displaced by the operator from the first position 11.1 into the second position 11.2, illustrated in FIG. 3B, in order then to be able to displace the cleaning device 3 from the operating position 3.1 into the maintenance position 3.2. During this opening of the opening 9, the protective covering 11 is separated from the above-mentioned safety switch, so that the latter no longer permits the press 1 to be started up as long as the opening 9 is unclosed.

As soon as the cleaning device 3 is in the maintenance position 3.2, the protective covering 11 is closed again (cf. FIG. 3B, phantom line) behind the cleaning device 3 removed from the printing unit 15. In that position, the protective covering 11 once more actuates the safety switch, so that the latter permits the machine run once more. At this time, the printing operation can be resumed and the cleaning device 3 is standing on the foot board 17 of the press 1. The foot board 17 is disposed between the printing unit 15 and an adjacent, further printing unit. In this case, the maintenance position 3.2 is therefore determined by the foot board 17 which, for this purpose, can be provided with guide rails adjoining the guide 8 in order to guide the cleaning device 3. The protective covering is then closed once more following the removal of the cleaning device 3 from the printing unit 15. The second position 11.2 is illustrated by a continuous line in FIG. 3B, and the first, closed position 11.1 is illustrated in phantom.

In the situation illustrated in FIG. 3B, there is no cleaning device 3 for cleaning the cylinder 2 in the printing unit 15, the press 1 is running in printing operation and one of the cloth rolls 5, 6 which contains the soiled cleaning cloth 4 can be replaced by another cloth roll, which contains the clean, fresh cleaning cloth 18, while the cleaning device 3, although outside the printing unit 15, is standing on the press 1, namely the foot board 17. A support table separate from the press 1 as a workbench for the maintenance of the cleaning device 3 is therefore not necessary in this case.

Figure 4:
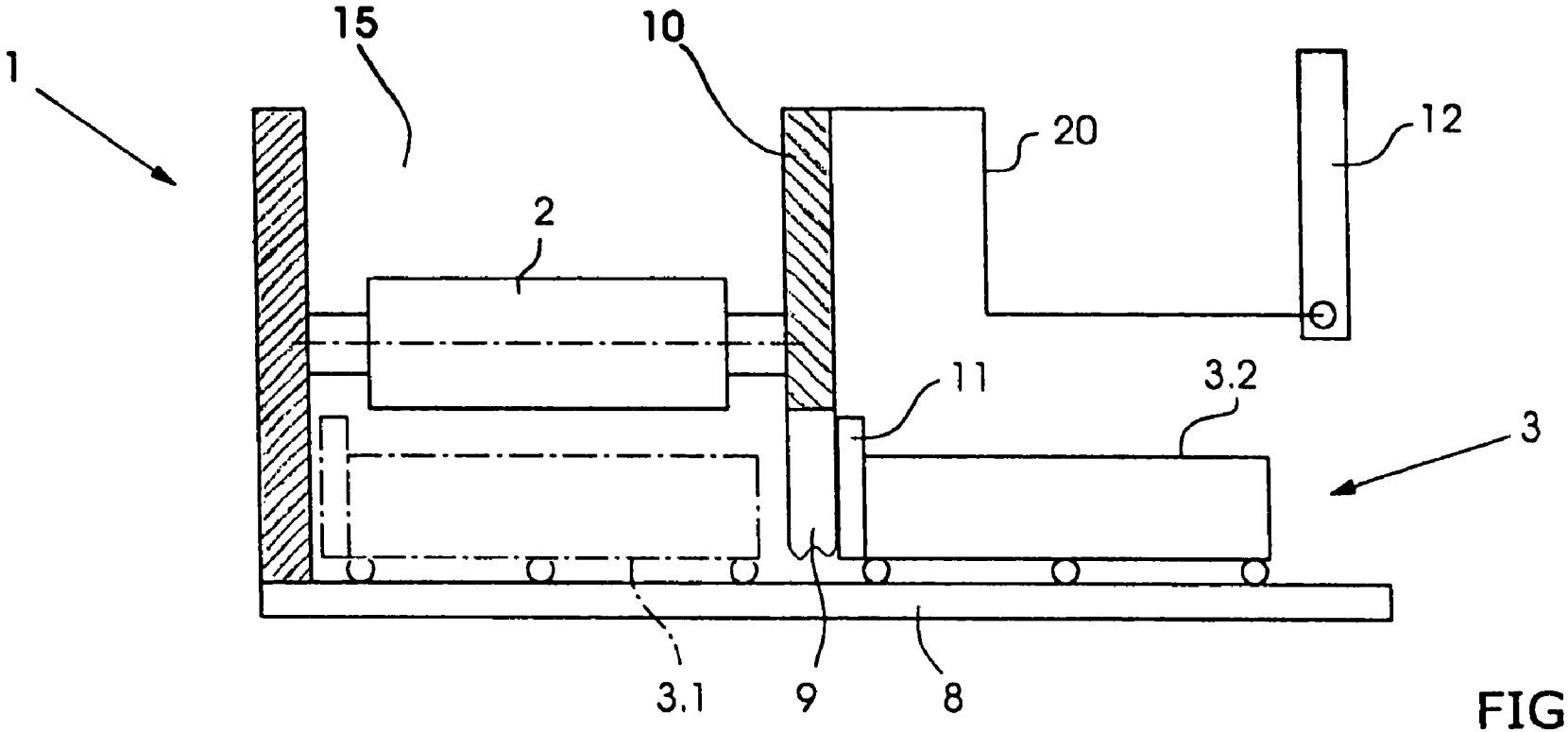
FIG. 4 illustrates a fourth exemplary embodiment, in which the protective covering is disposed as a side wall of the cleaning device.

While the wall 10 having the opening 9 extends parallel to an axis of rotation of the cylinder 2 in the exemplary embodiments according to FIGS. 1A to 3B and, accordingly, the guide 8 extends at right angles relative to the axis of rotation, this is not the case in the exemplary embodiment according to FIG. 4. Here, the wall 10 having the opening 9 extends at right angles relative to the axis of rotation of the cylinder 2 and, accordingly, the guide 8 extends parallel to the axis of rotation. In this case, during its removal from the printing unit 15 through the opening 9, the cleaning device 3 is, so to speak, moved along the cylinder 2, and the guide 8 projects far out of the opening 9. The wall 10 is one of two printing unit side walls in which the cylinder 2 is mounted. The section of the guide 8 projecting out of the printing unit 15 is located within a housing 20 and determines the maintenance position 3.2 in which the cleaning device 3 is out of its position opposite the cylinder 2. The remaining section of the guide 8, located within the printing unit 15, determines the operating position 3.1 of the cleaning device 3, in which the cleaning device 3 is in a position opposite the cylinder 2 to be cleaned.

If the cleaning device 3 is located in the maintenance position 3.2, the cleaning device 3 itself closes the opening 9 in the wall 10 with its rear side plate facing the printing unit 15, which functions as the first protective covering 11 and is therefore designed to be somewhat larger than the front side plate of the cleaning device 3, as is illustrated by a continuous line in the drawing in FIG. 4. The second protective covering 12 is used for opening the housing 20 in order to permit the operator access to the cleaning device 3 located in the maintenance position 3.2 and for closing the housing 20 after the cleaning device 3 has been displaced back into the operating position 3.1.

As opposed to the exemplary embodiments shown in FIGS. 1A to 2B, in which the two protective coverings 11, 12 are assigned to one and the same opening 9, in the exemplary embodiment shown in FIG. 4, the two protective coverings 11, 12 are assigned to different openings, specifically the first protective covering 11 to the opening 9 of the printing unit 15, and the second protective covering 12 to an opening in the housing 20 arranged in front of the printing unit 15.

However, in the exemplary embodiment shown in FIG. 4, the running of the press 1 in printing operation, the cylinder rotating, with the cleaning device 3 in the maintenance position 3.2 at the same time, is also possible. During this machine run, the operating position 3.1 is occupied neither by the cleaning device 3 nor by an identical cleaning device but is empty, as indicated by a phantom line in FIG. 4.

This application claims the benefit, under 35 U.S.C. § 119, of German patent application No. 10 2005 018 332.8, filed Apr. 20, 2005; the prior disclosure is herewith incorporated by reference in its entirety.

We claim:

1. A method for operating a press, comprising: providing the press with a printing unit having a cylinder and a cleaning device movably mounted for displacement into an operating position for cleaning the cylinder and into a maintenance position, wherein the operating position is defined within the printing unit and the maintenance position is defined outside the printing unit but on a component of the press, running the press in printing operation while maintaining the operating position free of the cleaning device and while disposing the cleaning device in the maintenance position on the component of the press outside of the printing unit.

2. The method according to claim 1, further comprising: providing the printing unit with an opening, a first protective covering for closing the opening, and a second protective covering for closing the opening, and keeping the opening closed with the first protective covering during the printing operation, and placing the cleaning device onto the second protective covering in the maintenance position.

3. The method according to claim 2, which comprises displacing the cleaning device from the operating position into the maintenance position and thereby automatically closing the first protective covering.

4. The method according to claim 3, which comprises effecting the automatic closure of the first protective covering with a spring.

5. The method according to claim 3, which comprises effecting the automatic closure of the first protective covering via a connecting element connecting the first protective covering to the cleaning device.

6. The method according to claim 1, further comprising: providing the printing unit with an opening and at least one protective covering connected to the cleaning device for closing the opening, and keeping the opening closed by way of the protective covering during running printing operation.

7. The method according to claim 1, which comprises providing a further cleaning device that is substantially identical and functioning as a replacement device for the cleaning device, and keeping the operating position free of the cleaning device and free of the further cleaning device during the printing operation.

8. A press configured to carry out the method according to claim 1.

* * * * *